US008863900B1

(12) United States Patent
Bolinger

(10) Patent No.: US 8,863,900 B1
(45) Date of Patent: Oct. 21, 2014

(54) TREE STEP

(76) Inventor: Billy Joe Bolinger, Creston, IA (US)

( * ) Notice: Subject to any disclaimer, the term of this patent is extended or adjusted under 35 U.S.C. 154(b) by 89 days.

(21) Appl. No.: 12/851,916

(22) Filed: Aug. 6, 2010

(51) Int. Cl.
*E06C 9/00* (2006.01)

(52) U.S. Cl.
USPC ..... 182/90; 182/92; 182/151

(58) Field of Classification Search
CPC ..... A63B 27/00; A63B 69/0048
USPC ..... 182/90, 92, 151; D25/69
See application file for complete search history.

(56) References Cited

U.S. PATENT DOCUMENTS 907,483 A * 12/1908 Ette ..... 182/90
3,298,459 A * 1/1967 Bergsten ..... 182/92
4,085,875 A * 4/1978 Campbell et al. ..... 294/158
4,382,416 A * 5/1983 Kellogg-Smith ..... 114/90
4,422,527 A * 12/1983 Schultz et al. ..... 182/92
4,618,028 A * 10/1986 Dale ..... 182/92
4,700,807 A * 10/1987 Kubiak ..... 182/92
4,708,221 A * 11/1987 Kubiak ..... 182/187
4,775,030 A * 10/1988 Wright ..... 182/92
4,867,272 A * 9/1989 Troubridge ..... 182/92
5,279,388 A * 1/1994 Laughlin et al. ..... 182/92
5,624,007 A * 4/1997 Mahaffy ..... 182/92
5,743,353 A * 4/1998 Browning et al. ..... 182/92
5,881,837 A * 3/1999 Leicht ..... 182/92
5,899,124 A * 5/1999 Cross, Jr. ..... 81/176.15
5,944,139 A * 8/1999 Kozial ..... 182/92
6,439,343 B1 * 8/2002 Jorges et al. ..... 182/92
7,017,449 B1 * 3/2006 Ritchings ..... 81/52
7,134,524 B2 * 11/2006 Sprague ..... 182/92
7,231,853 B1 * 6/2007 Burdge ..... 81/176.1
D631,980 S * 2/2011 Henry ..... D25/69
D631,981 S * 2/2011 Henry ..... D25/69
8,132,647 B2 * 3/2012 Salerno ..... 182/92
2002/0121406 A1 * 9/2002 Summers ..... 182/92
2008/0283335 A1 * 11/2008 Salerno ..... 182/133
2009/0045012 A1 * 2/2009 Mencl ..... 182/92

* cited by examiner

*Primary Examiner* — Katherine Mitchell
*Assistant Examiner* — Kristine Florio
(74) *Attorney, Agent, or Firm* — McKee, Voorhees & Sease

(57) ABSTRACT

A tree climbing system, the system comprising a tree climbing apparatus, the tree climbing apparatus including a handle portion, the handle portion including a first end portion, a second end portion and a ring portion including a top member, a bottom member, a first side member and a second side member, the ring portion defining an open interior portion, a threaded support member secured adjacent the first side member and the top member and a step member secured adjacent the second side member and the bottom member an installation tool, the installation tool including a first end, a second end and a handle near the first end and a carrier, the carrier including a carrier body sized to correspond with the open interior portion of the tree climbing apparatus.

11 Claims, 11 Drawing Sheets

TREE STEP

BACKGROUND OF THE INVENTION

1. Field of the Invention

The present invention relates generally to a tree climbing device for use by hunters and climbers. More particularly, though not exclusively, the present invention relates to a tree climbing device which improves safety while also improving ease of transportation and installation of the device.

2. Problems in the Art

Hunters and climbers use tree climbing equipment to ascend or climb a tree to a suitable elevation where typically a tree stand or other observation post is placed. There are a wide variety of climbing apparatus currently available. However, most are either difficult to install or require bands, ropes or other apparatus be placed and moved around the tree. Such systems can be cumbersome, heavy and difficult to use. It is therefore desirable to provide hunters and climbers with a simple, effective and easy to use apparatus for safely climbing trees.

Examples of prior attempts to solve these problems leave much to be desired. For example, U.S. Pat. No. 4,449,612 discusses a tree step. While this tree step is simple in its construction, it presents problems in installation and does not provide a closed handle or a way for hunters and climbers to secure their harness. Essentially, it is a step and nothing more. It is desirable to have a single device which can include a tree step, a handle to grasp, and an apparatus to which the hunter or climber can secure their safety or climbing harness.

Features of the Invention

A general feature of the present invention is a tree climbing apparatus which overcomes the problems found in the prior art.

A further feature of the present invention is the provision of a tree climbing apparatus which is easy to install.

A still further feature of the present invention is the provision of a tree climbing apparatus which incorporates a handle to grasp.

Another feature of the present invention is the provision of a tree climbing apparatus which is safe to use.

Another feature of the present invention is the provision of a tree climbing apparatus which is easy to transport.

A further feature of the present invention is the provision of a tree climbing apparatus which may be used to secure a harness.

A still further feature of the present invention is the provision of a tree climbing apparatus which is economical.

A further feature of the present invention is the provision of a tree climbing apparatus which is quietly transported.

These, as well as other features and advantages of the present invention, will become apparent from the following specification and claims.

SUMMARY OF THE INVENTION

The present invention generally comprises a tree climbing apparatus including a handle portion having a first end portion, a second end portion and a ring portion between the first end portion and the second end portion, a threaded support member connected to the first end portion of the handle portion and a step member connected to the second end portion of the handle portion.

In the preferred embodiment, the ring portion is made from a continuous wall and forms an open interior portion which is preferably generally rectangular shaped with a top member, a bottom member and two side members. Preferably, the top member and bottom members are parallel to one another and the two side members are also parallel to one another. The tree climbing apparatus is preferably constructed of metal, though any other suitably strong material can be used.

The tree climbing apparatus may be transported in a number of different ways. However, it is preferred that the tree climbing apparatus be transported in a carrier which attaches to the belt of a user. The carrier may be honeycomb shaped to allow for multiple tree climbing apparatus to be held in a plurality of holes. Alternatively, the carrier may use a bolt or support rod extending generally horizontally from a user's belt through a compressible carrier body. The user can slide the tree climbing apparatus ring portion over the carrier body and secure the apparatus with a pressure fit, snap fit or other securement device.

DETAILED DESCRIPTION OF THE PREFERRED EMBODIMENT(S)

The present invention will be described as it applies to its preferred embodiment. It is not intended that the present invention be limited to the described embodiment. It is intended that the invention cover all modifications and alternatives which may be included within the spirit and scope of the invention.

Figure 1A:
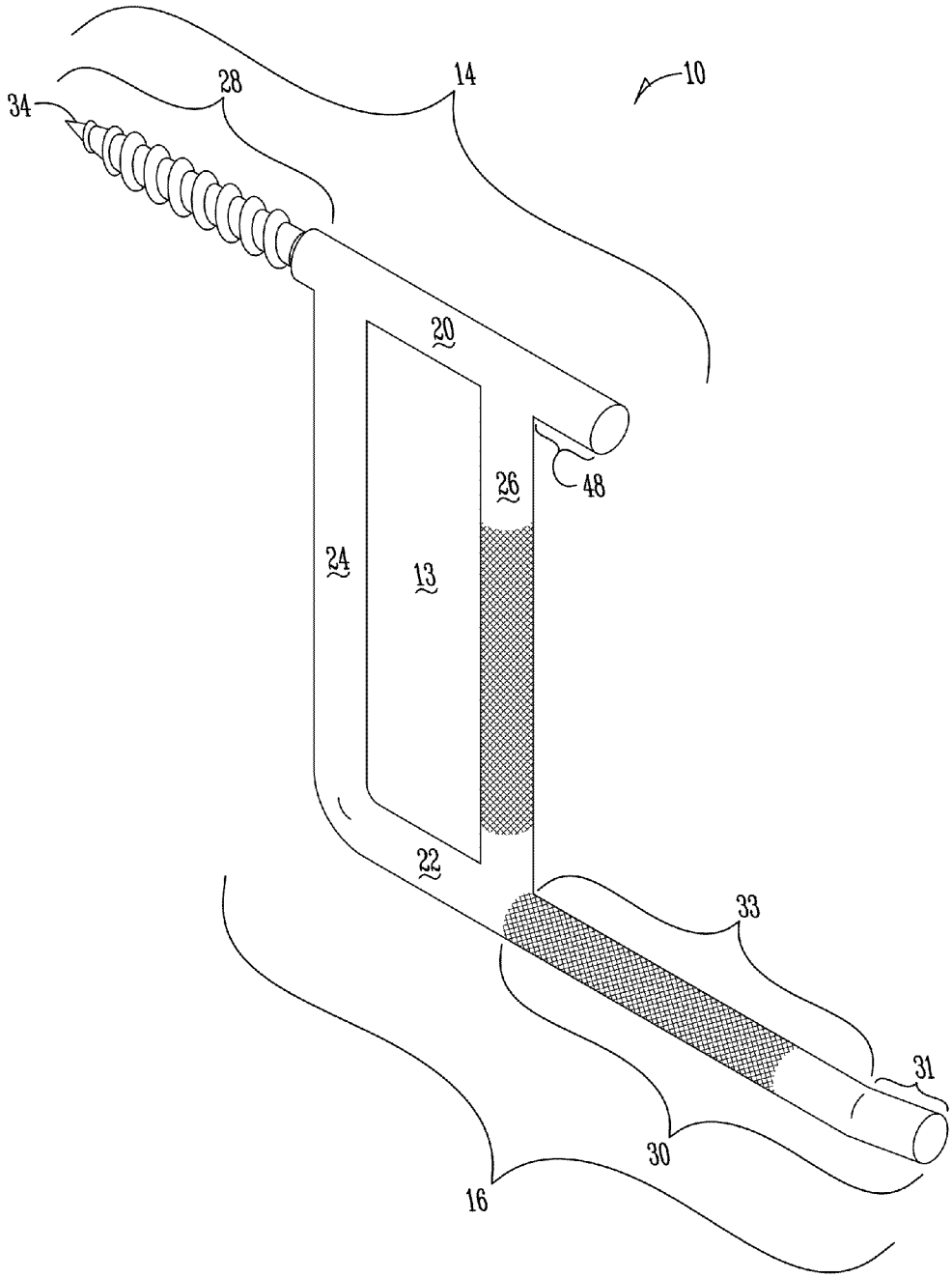
FIG. 1A is a perspective view of one embodiment of the tree climbing apparatus of the invention.
Figure 1B:
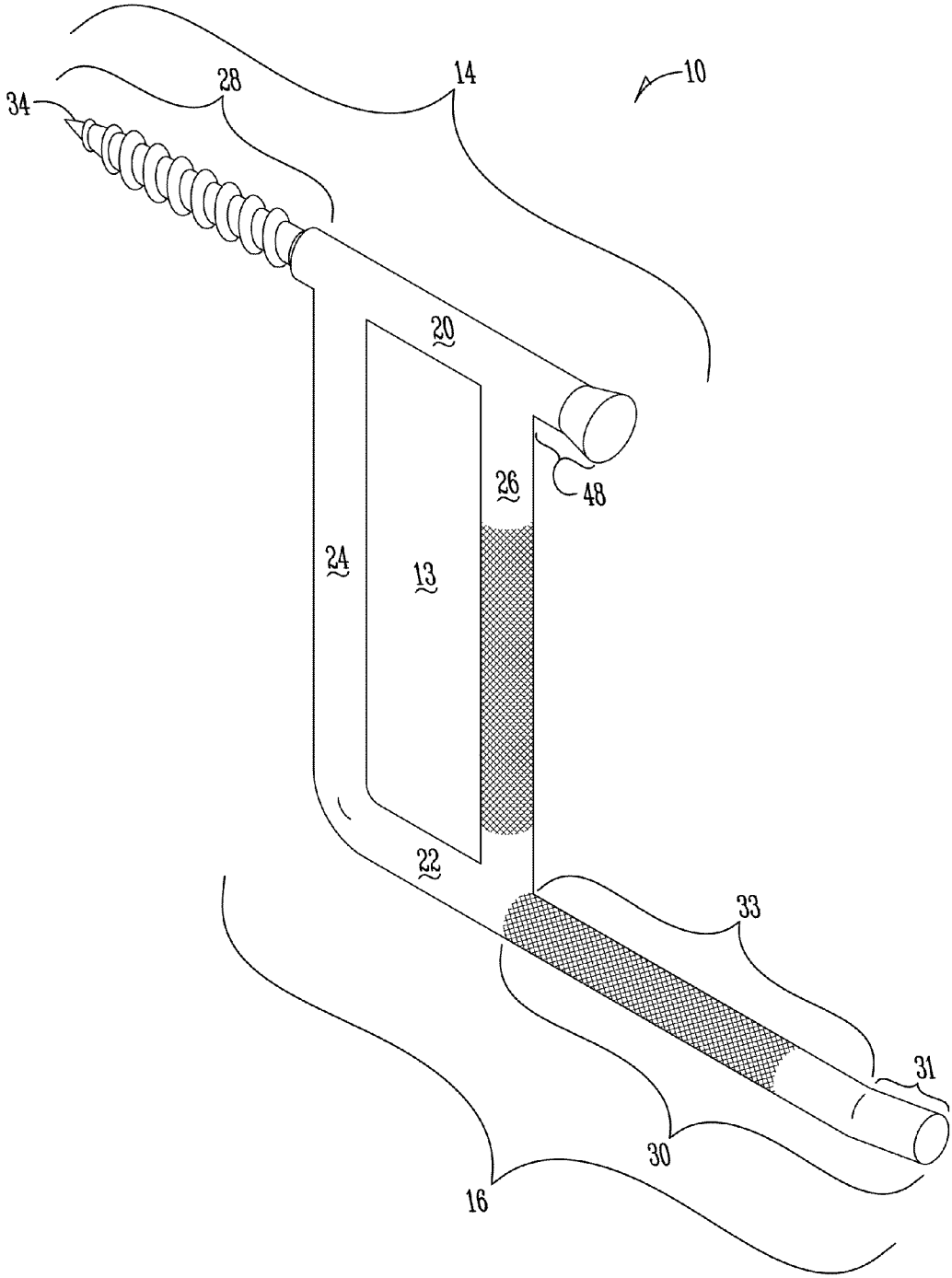
FIG. 1B is a perspective view of another embodiment of the tree climbing apparatus of the invention.
Figure 2:
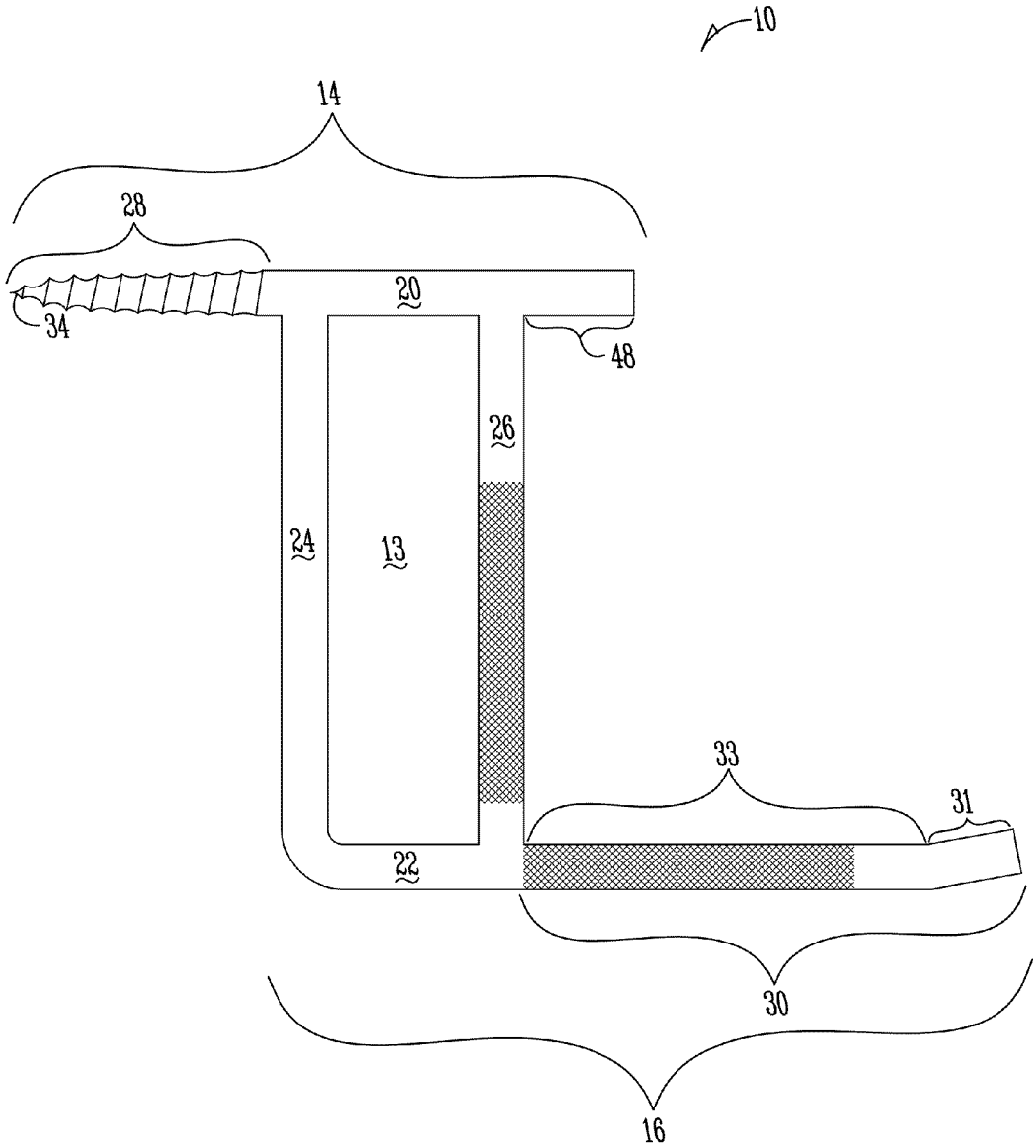
FIG. 2 is a side view of the embodiment shown in FIG. 1A.

Now, referring to the drawings, FIGS. 1A, 1B and 2 illustrate the tree climbing apparatus 10 of the present invention. Generally, the tree climbing apparatus 10 includes a handle 26 which is connected to a first end portion 14 and a second end portion 16.

The handle preferably includes a ring portion 13 formed from several sides, including a top member 20, a bottom member 22, a first side member 24 and a second side member 26. The second side member 26 becomes the handle. The ring portion 13 is what forms the open interior portion 18. While preferably sized to accommodate a human hand, the ring portion 13 may also be sized to accommodate a rope, harness clip or other climbing apparatus.

The tree climbing apparatus 10 is secured into a tree by a threaded support member 28. The threaded support member 28 may be secured anywhere along one side of the apparatus 10, but is preferably connected or secured to the apparatus 10 near or at the first end portion 14. The step member 30 is generally secured to the side of the apparatus 10 opposite of the side of the apparatus 10 on which the threaded support member 28 is located.

The tree climbing apparatus 10 is preferably constructed of a single piece of ⅜ inch of a thick strong metal. Molding using poured metal is the preferred method of construction as it eliminates the possibility of broken welds or weak joints. The threaded support member 28 is preferably 2½ inch long and includes tapered, coarse threads. The threads are complimented by the very sharp carbide tip 34 which will generally penetrate the densest of trees.

The step member 30 is preferably substantially longer than the threaded support member 28. Preferably, the step member 30 is 5 inches long and knurled for foot placement. The step member 30 preferably includes an end portion 31 which is angled, preferably around 45 degrees, relative to a body portion 33 to prevent the foot from slipping off of the step member 30. The entire tree climbing apparatus 10 is preferably painted in a black matte finish or camouflage to maximize the hunter's or climber's concealment if desired.

Figure 3:
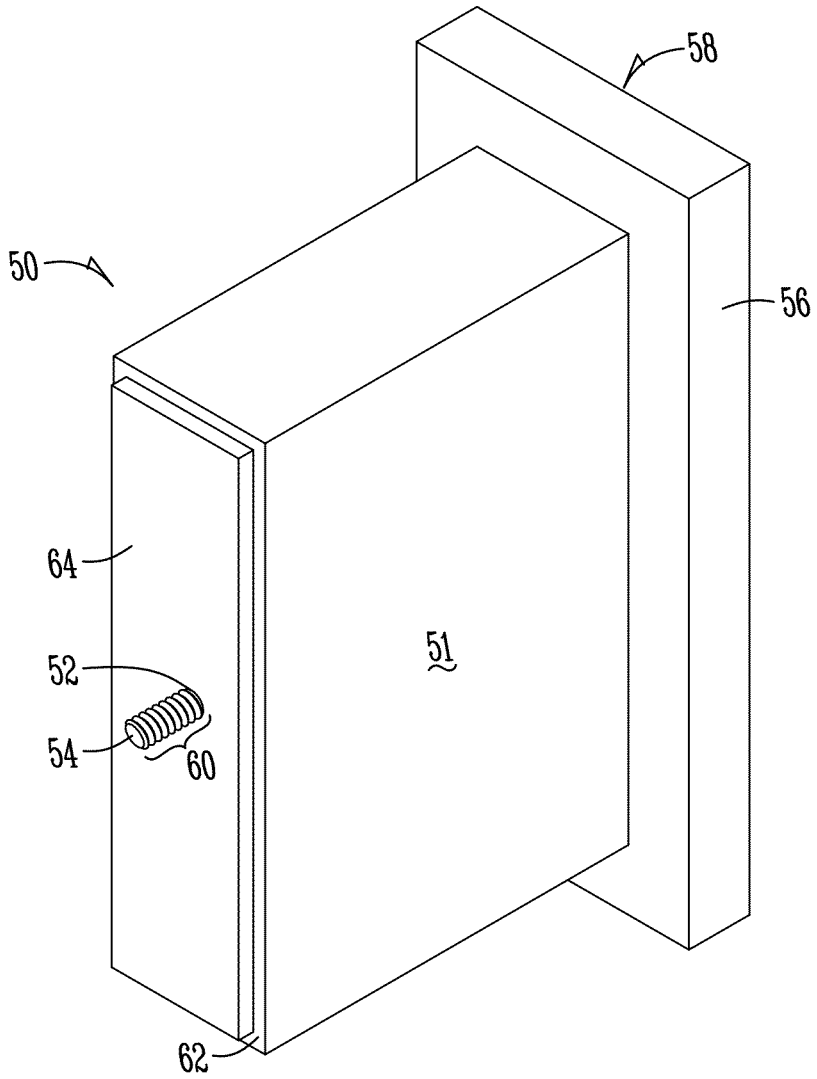
FIG. 3 is a perspective view of a portion of one embodiment of a carrying device.
Figure 4:
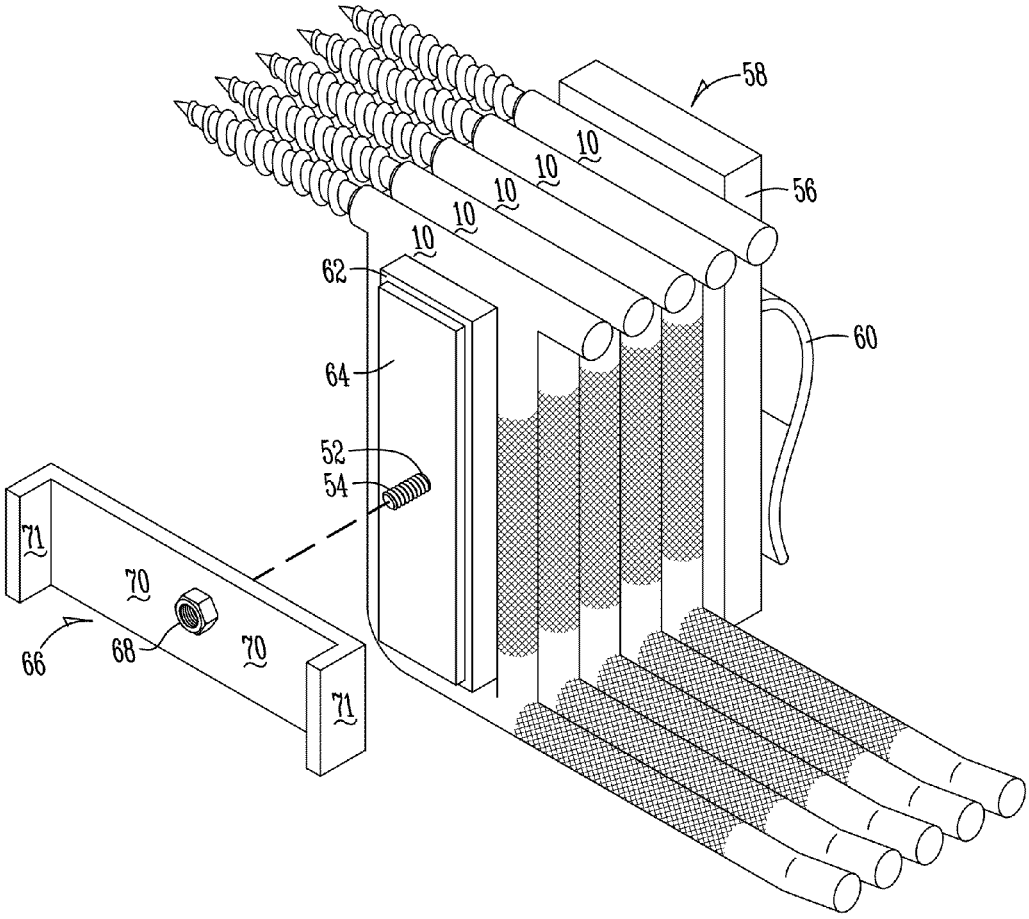
FIG. 4 is a perspective view of the embodiment of the carrying device of FIG. 3 including several of the tree climbing apparatuses shown in FIG. 1A.

As shown in FIGS. 3 and 4, the tree climbing apparatus 10 can be transported by inserting a carrier 50 which includes a compressible carrier body 51. Preferably, the carrier body 51 is constructed of a soft, rubber or composite compressible material or foam which is secured to a backing plate which may or may not include a belt clip or loop. A hole 52 is provided through at least a portion of the carrier body 51. A rod 54 or other securing support protrudes through the hole and is attached to the backing plate to provide horizontal stability to the carrier 50. Preferably, the carrier body 51 includes a portion which is a complimentary shape to the open interior portion 18 of the tree climbing apparatus 10 so that a plurality of tree climbing apparatus 10 can be slid onto the carrier body 51. The carrier 50 as shown includes a shoulder portion 56 which allows the climbing apparatus 10 to rest against the shoulder portion 56 without hitting the user.

Preferably, the carrier body 51 is 1 and 3/16 inches wide by 4 and 15/16 inches long and 3 inches tall. The shoulder portion 56 is 2 and ¼ inches wide by ½ inch thick and 5 and ½ inches tall. While the shoulder portion 56 acts as a base on which the first climbing apparatus 10 may rest, several additional climbing apparatuses 10 may be added as shown in FIG. 4.

As shown in FIG. 4, the carrier 50 preferably also includes a metal plate preferably secured on the first end 58 to which the rod 54 (which may be a ¼ inch bolt) is welded or otherwise secured. The metal plate may or may not be used, but is preferred to provide greater structural support. The rod 54 includes a threaded portion 60 which extends through the hole 52 in the carrier 50 and protrudes through the second end 62. A compression plate 64 and a securing device, shown here as a wing nut 66, are used to secure the climbing apparatuses 10 on the carrier body 51.

The compression plate 64 is preferably made of metal and may be slightly smaller than the carrier body 51 and preferably includes barbs or other frictional enhancements (not shown) on the side which contacts the carrier body 51 to minimize the movement of the compression plate 64 when turning the securing device 66 to secure the climbing apparatuses 10 in place. Preferably, after the desired number of climbing apparatuses 10 are placed on the carrier body 51, the securement device 66 is tightened, the carrier body 51 is compressed horizontally and thus expands somewhat in the vertical direction. This expansion helps to secure the climbing apparatuses 10 and minimizes the risk of the climbing apparatuses to slip or fall off.

The securement device 66 may be a wing nut, a lock nut or any other suitable fastener. Preferably, the securement device 66 includes a threaded portion 68 to which a plurality of wings 70 are secured. The wings 70 may extend wider than the width of the open interior portion and may be formed in a single piece. This makes the securement device 66 a secondary catch to prevent the climbing apparatus 10 from being separated from the carrier 50. This is especially true when the wings 70 are left in a transport position, which is preferably perpendicular to the widest portion of the carrier body 51.

The wings 70 also provide greater surface area for the user to grasp when tightening or loosening the securement device 66 and may include ends 71 which have an upward turned surface or other shape to aid in tightening or loosening. The soft material used in the carrier 50 minimizes noise while keeping the climbing apparatuses 10 from excessive movement. In an alternative embodiment, the carrier body 51 may include a plurality of holes which are perpendicular to the widest portion of the carrier body 51. The holes (not shown) are preferably slightly smaller in diameter than the step member 30. This allows for the climbing apparatus 10 and even prior art versions to be stored on the carrier body 51. If constructed of sufficiently rigid material, the carrier 50 of this embodiment will not need the compression plate 64 and securement device 66 if storage is only sought in the holes.

Figure 6A:
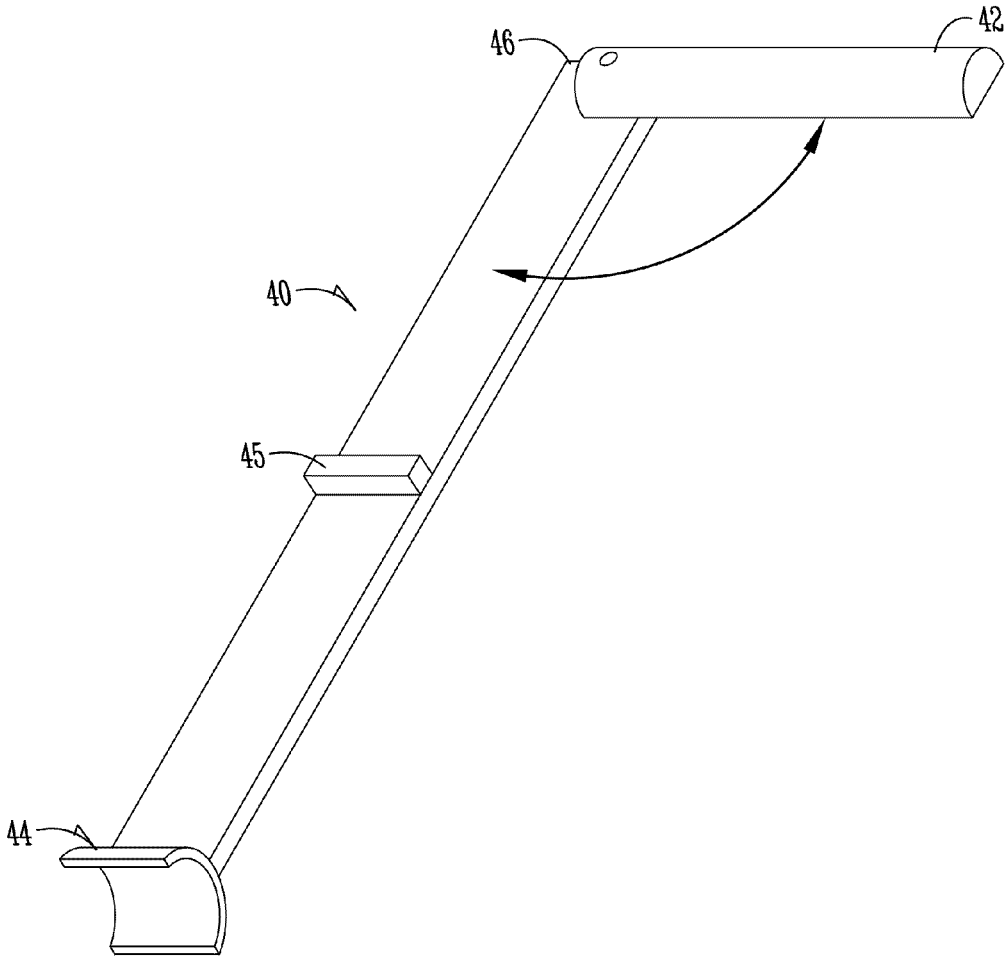
FIG. 6A is a perspective view of the installation tool.
Figure 6B:
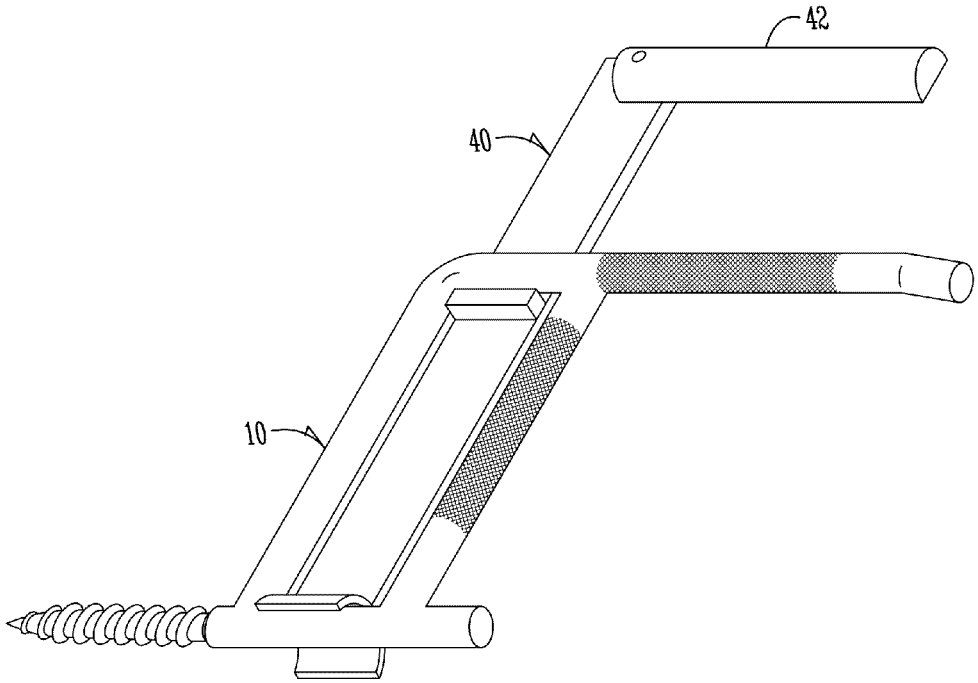
FIG. 6B is a perspective view of the installation tool ready for use.

As shown in FIGS. 6A and 6B, the tree climbing apparatus 10 can be installed by screwing the threaded support member 28 into the side of a tree. The step member 30 may be used as a crank handle to turn the tree clinking apparatus 10 so as to screw in the threaded support member 28. Alternatively, because of the ring portion 13 of the apparatus 10, the user can employ additional leverage if necessary. For example, using an installation tool 40, the user can likely turn the tree climbing apparatus 10 into even the toughest of trees. Preferably, the installation tool 40 is a flat or hollow-shaped piece of aircraft grade aluminum to reduce weight while maintaining strength. The installation tool 40 preferably includes a "C" or "U" shaped end 44 which can slide over a portion of the ring portion 13. While described as being "C" or "U" shaped, the end 44 is preferably shaped to match or receive a profile of the bottom portion 22 of the ring portion 13. The installation tool 40 also preferably includes a stop 45 positioned to make contact slightly inside the ring portion 13 at it position generally opposite from the side contacted by the end 44 as shown in FIG. 6B. Preferably, the stop 45 contacts the ring portion 13 below the top member 20. The stop 45 helps to secure the installation tool 40 and minimize slippage.

Preferably, the tool 40 also includes a swivel handle 42 at the end 46 opposite from the end 44. The swivel handle 42 is preferably knurled to provide a gripping surface. The swivel handle 42 is shown to have a half moon cross-section, but may have a cross-section of any desired shape. Though not shown in FIG. 6A or 6B, the handle in FIGS. 7-9 may be preferred if gloves are worn as the round cross-section will allow easier rotation. Once the "C" or "U" shaped end 44 has been placed over one of the sides of the ring portion 13, the installation tool 40 will be ready for use. This provides all of the leverage needed to safely install and remove the tree climbing apparatus 10.

Figure 5:
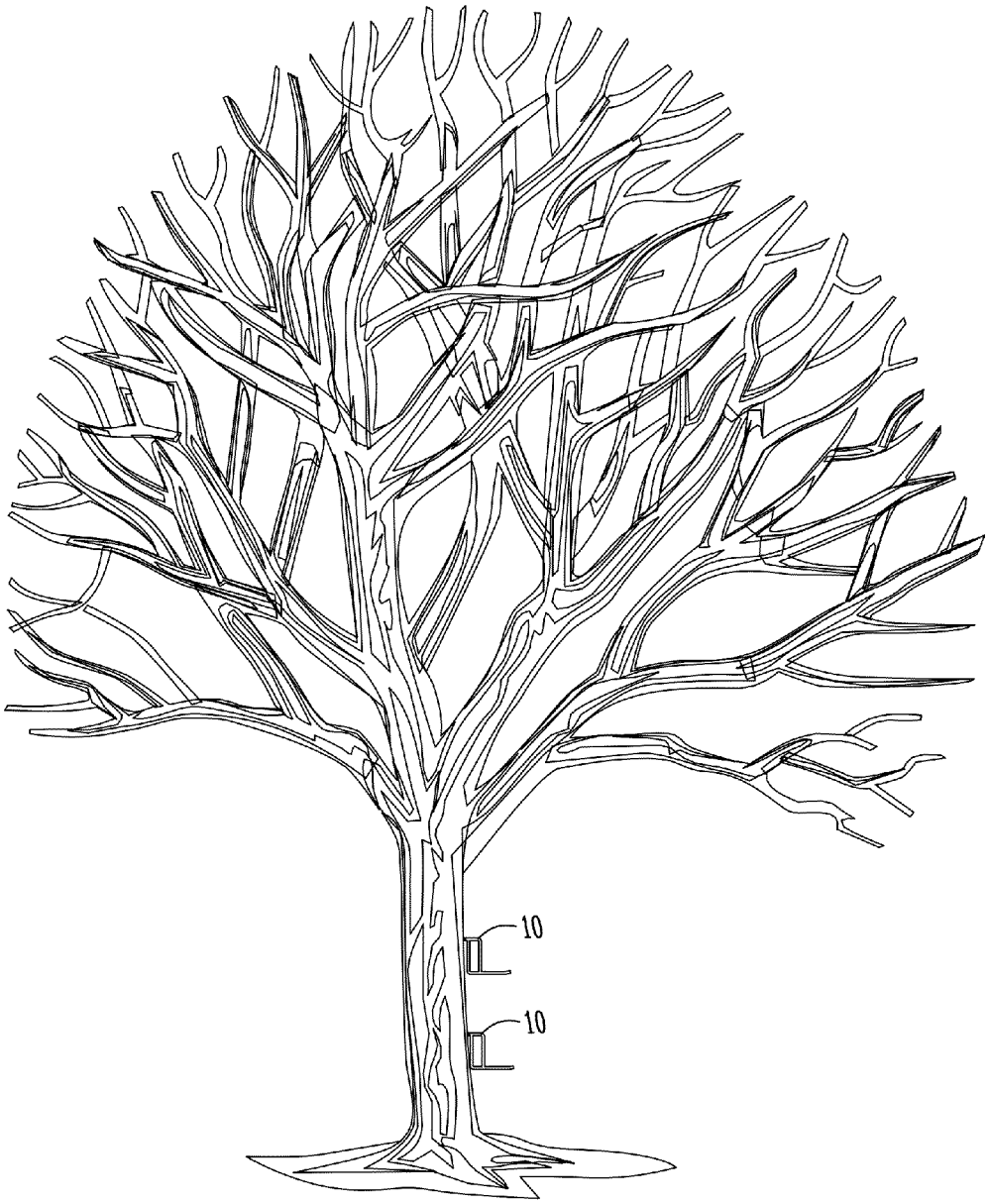
FIG. 5 is a side view of the embodiment shown in FIGS. 1A and 2 as installed into a tree.

In use, several of the tree climbing apparatuses 10 are installed at various locations on a tree as shown in FIG. 5. A user can easily grasp the handle 12. An extension portion 48 as shown in FIG. 1A may be included outside of the open interior portion 18 and near the second side member 26 to help prevent the user's hand from sliding up and for off of the apparatus 10. As shown the extension portion 48 is a simple continuation of the top member 20. The extension portion 48 may be straight or include a tapered portion as shown in FIGS.

1A *and* 1B. If the extension portion 48 is used, an installation tool 72 such as that shown in FIGS. 7-9 may be used.

Figure 7:
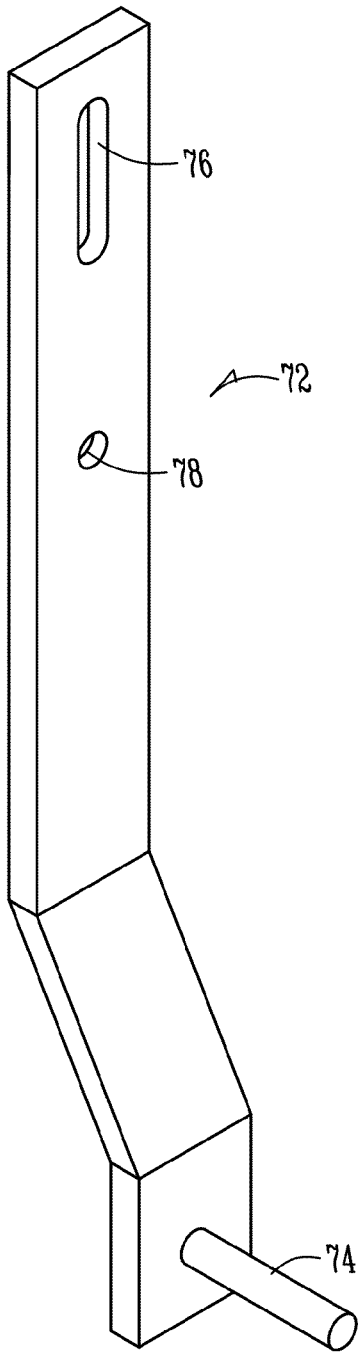
FIG. 7 is a perspective view of another embodiment of an installation tool.
Figure 8:
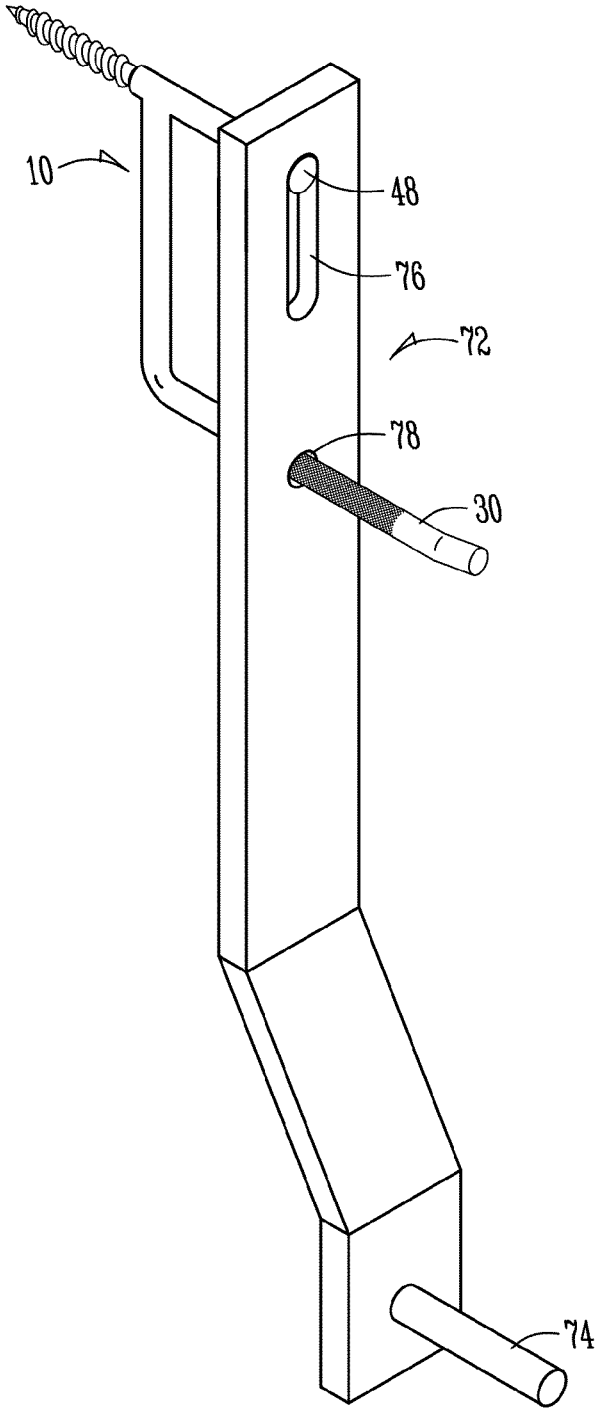
FIG. 8 is a perspective view of the embodiment of FIG. 7 in use.
Figure 9:
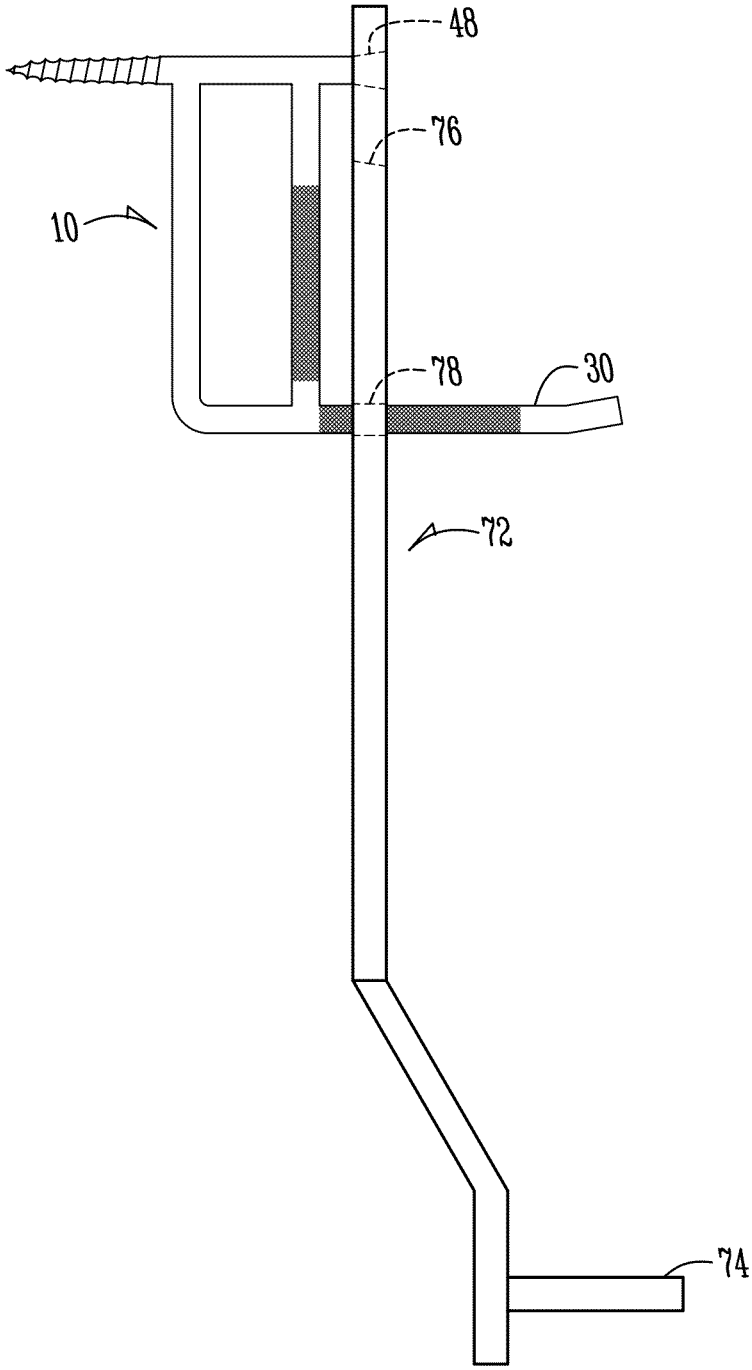
FIG. 9 is a side view of the apparatus shown in FIG. 8.

As shown in FIGS. 7-9, the installation tool 72 includes a turning handle 74 and one or more slots 76, 78. The turning handle 74 is preferably positioned at or near one end of the installation tool 72, opposite from the slots 76, 78. The installation tool 72 may include one or more bends or pieces. The turning handle 74 is preferably located in a position to minimize potential interference from the step member 30 so that the user will not hit the step member 30 while turning the installation tool 72 and holding on to the turning handle 74.

The slots 76, 78 are sized to fit over the extension portion 48 and the step member 30. The slot 76 is preferably sized to fit over the extension portion 48. The slot 78 is preferably sized to fit over the step member 30. Alternatively, the slots 76 and 78 can be combined into a single slot, so long as multiple points of contact are made with the tree climbing apparatus 10. By having the installation tool 72 contact both the extension portion 48 and the step member 30 at the same time, force can be applied to install or remove the tree climbing apparatus 10. Preferably, at least slot 76 has sides which are tapered to match the taper on the extension 48 as shown in FIG. 1B. By tapering both the slot 76 and the extension portion 48, when the installation tool 72 is used, it is less likely to slide off inadvertently.

Alternatively, notches (not shown) or stops (not shown) can be placed on one or more sides of the installation tool 72 to provide the second point of contact instead of slot 78. The notches (not shown) or stops (not shown) would be shaped to receive a profile of the step member 30. Notches or stops could be used for both slots, but are not preferred because of the potential for slippage when the installation tool 40, 72 is not used through the ring portion 13 as shown in FIG. 6B or with the slots 76, 78 as shown in FIGS. 7, 8 and 9.

A general description of the present invention as well as a preferred embodiment of the present invention has been set forth above. Those skilled in the art to which the present invention pertains will recognize and be able to practice additional variations in the methods and systems described which fall within the teachings of this invention. Accordingly, all such modifications and additions are deemed to be within the scope of the invention which is to be limited only by the claims appended hereto.

What is claimed is:

1. A tree climbing apparatus, the apparatus comprising:

a ring portion including a top member having a longitudinal axis, a bottom member having a longitudinal axis, a first side member, a second side member, the ring portion defining an open interior;

a threaded support member having a longitudinal axis wherein the threaded support member longitudinal axis is co-linear with the top member longitudinal axis and wherein the threaded support member is secured to the top member and adjacent the first side member and wherein the threaded support member extends from the top member in a first direction; and a step member having a longitudinal axis, wherein the step member is secured to the ring portion in line with the bottom member and adjacent the second side member and wherein the step member longitudinal axis is co-linear with the bottom member longitudinal axis and wherein the step member longitudinal axis is parallel to the threaded support member longitudinal axis and wherein the step member extends from the bottom member in a second direction wherein the second direction is opposite the first direction; and wherein the top member, bottom member, first side member, second side member, threaded support member and step member are a single piece and are co-planar.

2. The tree climbing apparatus of claim 1 wherein the step member includes a section which is knurled.

3. The tree climbing apparatus of claim 1 wherein the step member includes an end portion which is angled relative to a main body portion.

4. The tree climbing apparatus of claim 1 wherein the ring portion is generally a rectangular shape.

5. The tree climbing apparatus of claim 1 further comprising an extension member located on a side of the second side member opposite the open interior portion and extending opposite from the threaded support member.

6. The tree climbing apparatus of claim 1 further including an installation tool.

7. A tree climbing system, the system comprising:

a tree climbing apparatus, the tree climbing apparatus including:

a ring portion including a top member having a longitudinal axis, a bottom member having a longitudinal axis, a first side member and a second side member, the ring portion defining an open interior;

a threaded support member having a longitudinal axis wherein the threaded support member longitudinal axis is co-linear with the top member longitudinal axis and wherein the threaded support member is secured to the top member and adjacent the first side member and wherein the threaded support member extends from the top member in a first direction;

a step member having a longitudinal axis, wherein the step member is extending from the bottom member and adjacent the second side member and wherein the step member longitudinal axis is co-linear with the bottom member longitudinal axis and wherein the step member longitudinal axis is parallel to the threaded support member longitudinal axis and wherein the step member extends from the bottom member in a second direction wherein the second direction is opposite the first direction;

wherein the top member, bottom member, first side member, second side member, threaded support member and step member are a single piece and are co-planar;

an installation tool, the installation tool including a first end, a second end and a handle near the first end; and a carrier, the carrier including a carrier body sized to correspond with the open interior portion of the tree climbing apparatus.

8. A tree climbing apparatus, the apparatus comprising:

a ring portion including a top member having a longitudinal axis, a bottom member having a longitudinal axis, a first side member and a second side member, the ring portion defining an open interior;

a threaded support member having a longitudinal axis wherein the threaded support member longitudinal axis is co-linear with the top member longitudinal axis and wherein the threaded support member is secured to the top member adjacent the first side member and wherein the threaded support member extends from the top member in a first direction; and a step member having a longitudinal axis wherein the step member is secured to the ring portion in line with the bottom member and adjacent the second side member and wherein the step member longitudinal axis is co-linear with the bottom member longitudinal axis and wherein the step member longitudinal axis is parallel to the threaded support member longitudinal axis and wherein the step member extends from the bottom member in a second direction wherein the second direction is opposite the first direction;

wherein the top member, bottom member, first side member, second side member, threaded support member and step member are a single piece and are co-planar;

the tree climbing apparatus further including an installation tool; and wherein the installation tool includes a first end, a second end shaped to contact the ring portion near the top member.

9. The tree climbing apparatus of claim 8 wherein the installation tool includes a handle near the first end and a first slot near the second end.

10. The tree climbing apparatus of claim 9 including a second slot.

11. The tree climbing apparatus of claim 9 wherein the slot is tapered.

* * * * *